US009486028B1

(12) United States Patent
VanHoutin et al.

(10) Patent No.: US 9,486,028 B1
(45) Date of Patent: Nov. 8, 2016

(54) CHIN STRAP BUCKLE ASSEMBLY FOR SPORTS HELMET

(71) Applicant: KRANOS IP CORPORATION, Litchfield, IL (US)

(72) Inventors: Louis Anthony VanHoutin, Luka, IL (US); Norman M. Halpin, Carlinville, IL (US); Cortney Warmouth, Edwardsville, IL (US); Robert Erb, Plandome, NY (US); Vincent R. Long, St. Peters, MO (US)

(73) Assignee: KRANOS IP CORPORATION, Litchfield, IL (US)

( * ) Notice: Subject to any disclaimer, the term of this patent is extended or adjusted under 35 U.S.C. 154(b) by 27 days.

(21) Appl. No.: 14/790,508

(22) Filed: Jul. 2, 2015

(51) Int. Cl.
*A42B 3/08* (2006.01)
*A44B 17/00* (2006.01)
*A44B 11/04* (2006.01)

(52) U.S. Cl.
CPC ..... *A42B 3/08* (2013.01); *A44B 11/04* (2013.01); *A44B 17/0005* (2013.01); *A44B 17/0023* (2013.01)

(58) Field of Classification Search
CPC ..... A42B 3/08; A44B 11/04; A44B 11/006; A44B 11/14; A44B 17/0023; A44B 17/005; Y10T 24/3424; Y10T 24/4088; Y10T 24/4093
USPC ..... 24/265 R, 265 EC, 265 AL, 615, 324
See application file for complete search history.

(56) References Cited

U.S. PATENT DOCUMENTS 1,712,976 A * 5/1929 Blair ..... A43C 11/02 24/324
3,237,257 A * 3/1966 Forsberg ..... A44B 11/006 24/324
3,977,839 A * 8/1976 Palisin, Jr. ..... C25D 5/48 205/196
5,259,096 A * 11/1993 Grant ..... A44B 17/0011 24/324
6,481,066 B1 * 11/2002 Ide ..... A44B 11/04 24/324
6,497,012 B2 * 12/2002 Ide ..... A44B 11/04 24/324
6,532,632 B1 * 3/2003 Halstead ..... A44B 11/04 24/196
7,246,384 B2 * 7/2007 Bentz ..... A42B 3/08 2/421
7,475,453 B2 * 1/2009 Drake ..... A44B 11/04 24/324
D628,515 S * 12/2010 Schiebl ..... D11/218
8,056,151 B2 * 11/2011 Bologna ..... A42B 3/08 2/421
8,813,317 B2 * 8/2014 Mitchell, Jr. ..... A42B 3/08 24/324
D713,759 S * 9/2014 Guney ..... D11/218
D714,683 S * 10/2014 McEntyre ..... D11/218
9,125,446 B2 * 9/2015 Wegener ..... A42B 3/08

(Continued)

*Primary Examiner* — Robert J Sandy
*Assistant Examiner* — Rowland Do
(74) *Attorney, Agent, or Firm* — Notaro, Michalos & Zaccaria P.C.

(57) ABSTRACT

A buckle assembly for a chin strap of a helmet has a metal part connected to a non-marring part. The metal part includes a metal plate with an outer perimeter, end portions and a center portion, and a slot in each end portion and a snap member fixed to the center portion. The non-marring part includes a tray with end and side walls. The end and side walls together defining an inner perimeter corresponding to and receiving the outer perimeter of the metal plate. A shelf extends side-to-side on an inner surface of each end wall, a plurality of locking tabs are on an inner surface of each side wall and at least one intermediate portion is connected to the inside surface of each side wall. The metal plate rests on the shelves and on the intermediate portion(s) and is being locked in the tray by the locking tabs.

23 Claims, 10 Drawing Sheets

(56) References Cited

U.S. PATENT DOCUMENTS

| | | | | |
|---|---|---|---|---|
| 9,144,270 | B2 * | 9/2015 | Mitchell, Jr. | A44B 11/16 |
| D750,530 | S * | 3/2016 | VanHoutin | D11/218 |
| D760,067 | S * | 6/2016 | Geiger | D8/354 |
| 2002/0148081 | A1 * | 10/2002 | Ide | A44B 11/04 24/324 |
| 2006/0242803 | A1 * | 11/2006 | Drake | A44B 11/04 24/324 |
| 2007/0193006 | A1 * | 8/2007 | Kitano | A44B 17/0011 24/323 |
| 2014/0068843 | A1 * | 3/2014 | Wegener | A42B 3/08 2/421 |

* cited by examiner

CHIN STRAP BUCKLE ASSEMBLY FOR SPORTS HELMET

FIELD AND BACKGROUND OF THE INVENTION

The present invention relates generally to the field of sports helmets, and in particular to a new and useful buckle assembly for the chin strap of a sports helmet, such as, but not limited to, a football, lacrosse or hockey helmet.

Buckles for the chin strap of sports helmets are usually made of metal for strength. Metal buckles, however, have the drawback of having hard, potentially sharp edges that can catch on clothing or the skin of the user or of a competitor or team mate. A metal buckle can also scratch the surface of a helmet or other sports equipment, especially in fast moving contact sports like football, lacrosse and hockey.

U.S. Pat. Nos. 6,481,066; 6,497,012; and 6,532,632 disclose a buckle for receiving a strap and for snap-fitting to a snap member or stud located on a helmet, the buckle including a metal member with plastic material substantially encasing the metal member except at certain areas. These patents teach complex and costly co-molding of the metal parts of the buckle with a molten plastic to partially encase the metal component. Co-molding equipment is therefore required and more of the buckle is covered than is necessary for safety.

U.S. Pat. No. 7,475,453 discloses a buckle including a metal component with a rust resistant plastic component substantially encasing the metal component. Encasing the metal parts inside the plastic components is again complex and costly.

Accordingly a need remains for a buckle assembly that shields metal parts of the bucket to reduce or eliminate the danger and potential damage exposed metal buckle parts may cause when used with the helmet of a contact sport.

SUMMARY OF THE INVENTION

It is an object of the present invention to provide a buckle assembly for holding a chin strap to a sports helmet, that comprises a metal part that is securely connected to a plastic part in a manner that cannot easily be disconnected. The metal part comprises a metal plate having an outer perimeter with opposite end portions and a center portion between the end portions, a slot extending side-to-side in each end portion for receiving the strap, and a snap member, e.g. a female snap member of a snap set, fixed to the center portion. A mating male span member of the snap set would be fixed at an appropriate location to the sports helmet. The snap members can alternatively be reversed, with the male member being on the buckle assembly and the female member being on the helmet, within the invention.

The non-marring part comprises a tray, made for example of polycarbonate, having two end walls and two side walls connected between the end walls, the end and side walls together defining an inner perimeter corresponding in shape to, and receiving, the outer perimeter of the metal plate. A shelf extends side-to-side on an inner surface of each end wall, a plurality of locking tabs are on an inner surface of each side wall and at least one intermediate portion is connected to the inside surface of each side wall. The metal plate rests on the shelves and on each intermediate portion, and is securely locked in and to the tray by the locking tabs.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
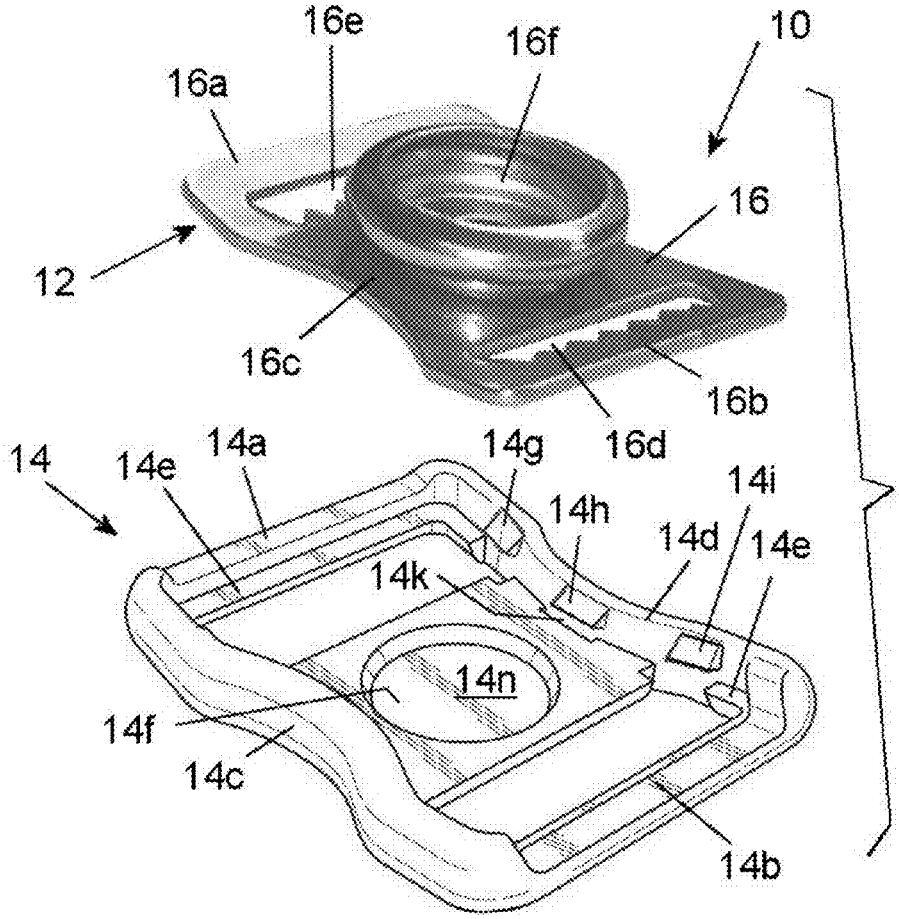
FIG. 1 is an exploded perspective view of the buckle assembly of the invention before a metal part of the buckle is mated to a non-marring part of the assembly.

Referring now to the drawings, in which like reference numerals are used to refer to the same or functionally similar elements, FIG. 1 illustrates a buckle assembly 10 for holding a chin strap (not shown) to a sports helmet (not shown). The buckle assembly comprises a metal part 12 securely connected to a non-marring part 14.

The metal part can be made of any suitably strong metal such as, but not limited to, stainless steel or aluminum. The non-marring part can be made of any suitably strong synthetic material such as, but not limited to, polycarbonate or ABS (Acrylonitrile Butadiene Styrene). The non-marring part may also be coated with a layer of polytetrafluoroethylene (PTFE), for example, as sold under the trademark TEFLON by DuPont Co.

The non-marring or protective part 14 forms a protective buckle sleeve and can be made of any non-marring material or material combination that is less likely to scratch a helmet shell or catch on clothing or injure a player. Non-limiting examples include: graphite, ceramic, any strong plastic or plastic coated structure such as PTFE coated metal, or a copolymer of ethylene and methacrylic acid that is available from Dupont under the trademark SURLYN, or glass-filled nylon.

Figure 8:
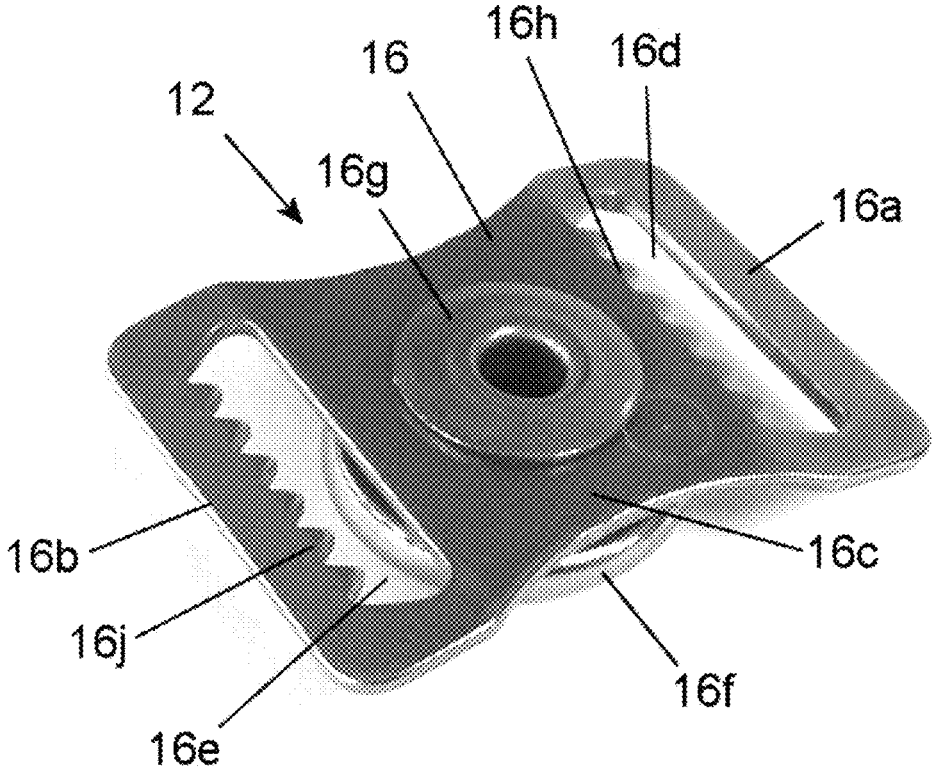
FIG. 8 is an outside perspective view of the metal part of the buckle assembly before it is connected to the non-marring part.

The metal part 12 comprises a metal plate 16 having an outer perimeter with opposite end portions 16*a* and 16*b*, and a center portion 16*c* between the end portions. The center portion 16*c* is advantageously narrower than the end portions 16*a* and 16*b* for a compact buckle profile. A slots 16*d* and 16*e* extend side-to-side in each end portion. A snap member 16*f*, such as but not limited to a female snap member, is fixed to the center portion 16*c*, for example, by a rivet 16*g* shown in FIG. 8, that extends through aligned holes in the center portion 16*c* and in the snap member 16*f*. The enlarged head of the rivet 16*g* is visible in FIG. 8, while the opposite end of the rivet is flared in the usual manner inside the snap member, for securing the snap member to the plate 16, the flared end being partly visible on FIG. 2.

Figure 2:
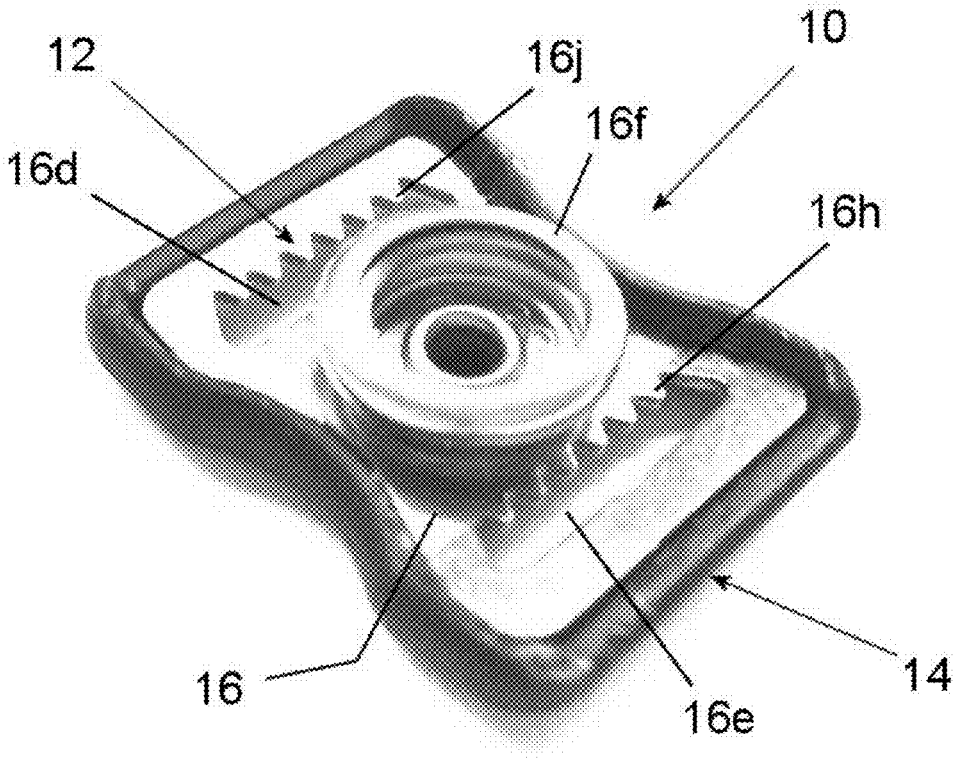
FIG. 2 is an inside perspective view of the assembly, ready to receive a chin strap and be snapped to a mating snap member fixed a sports helmet.
Figure 3:
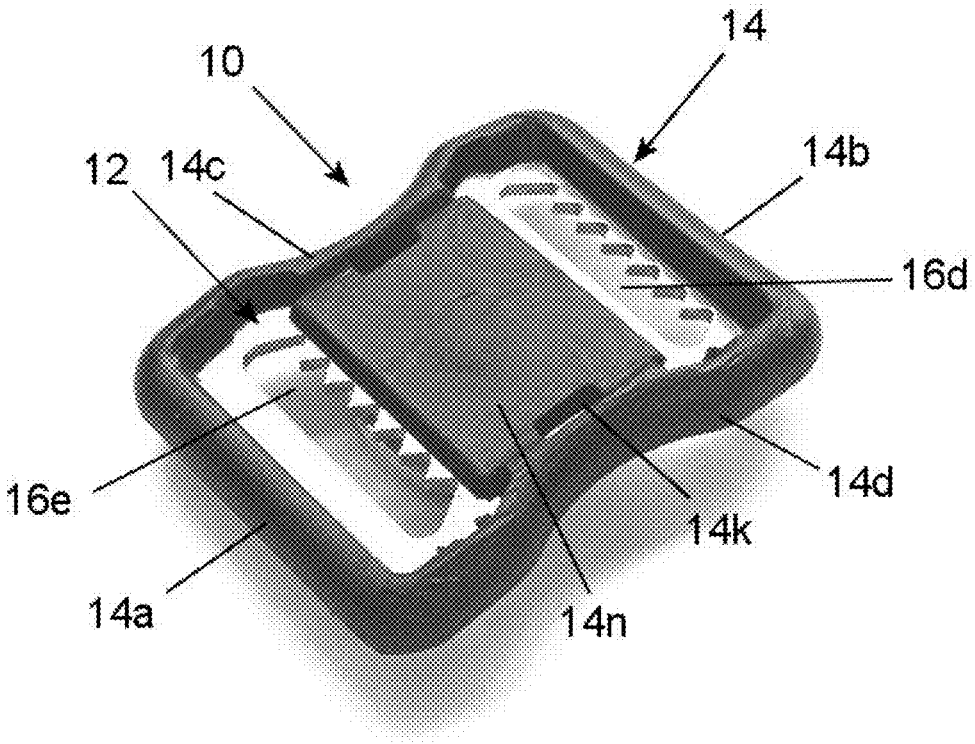
FIG. 3 is an outside perspective view of the buckle assembly.

With reference to FIGS. 1, 2 and 3, the non-marring part 14 comprises a tray made of polycarbonate or other strong plastics material. The tray has two end walls 14*a* and 14*b*, and two side walls 14*c* and 14*d* that are connected between the end walls. The end and side walls together defining an inner perimeter corresponding in shape and size to the outer perimeter of the metal plate 16, and closely receives the metal plate within the tray. A shelve 14*e* and 14*e*, extend side-to-side on an inner surface of each end wall, and each extends partly onto the inner surfaces of the adjacent side walls 14*c* and 14*d* as well.

Three wedge-shaped locking tabs 14*g*, 14*h* and 14*i* are molded into the inner surface of each side wall 14*c* and 14*d*.

Figure 6:
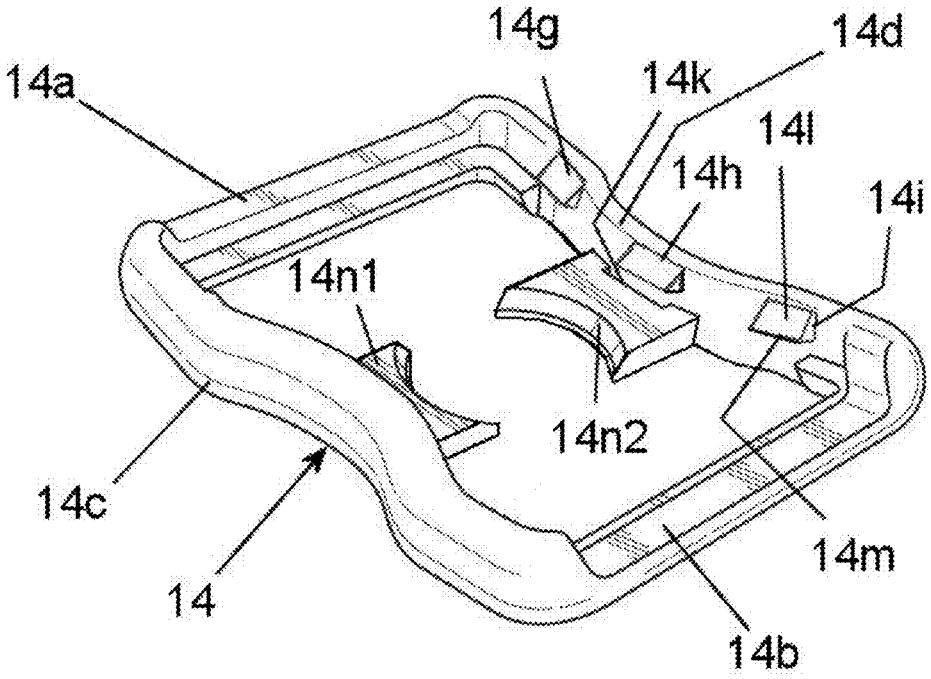
FIG. 6 is an inside perspective view of the non-marring part of a still further embodiment of the buckle assembly of the invention.

As best shown in FIG. 6, each wedge-shaped locking tab has an entry surface 141 that is inclined with respect to the inner surface of the side wall to which the locking tab is connected, and a locking surface 14*m* that is substantially perpendicular to the inner surface of the side wall to which the locking tab is connected. By this structure and the slight resiliency to the plastic making up the non-marring part 14, the metal plate 16 can be forces down onto the inclined tab surfaces 141, to slightly spread the tray sideways. Once a side edge of the plate 16 slides down the full length of the inclined tab surfaces 141, the side wall can rebound inwardly to bring the locking surface 14*m* over the plate edge and lock the metal part 12 to the non-marring part 14. This operation can be expedited by first wedging the opposite side edge of plate 16, under the locking tabs on the opposite side wall 14*c*, so that the other plate edge need pass only one set of tabs 14*g*, 14*h* and 14*i* on the opposite side wall.

While more or fewer locking tabs may be utilized according to the by the invention, it has been found that this combination so securely fixes the metal part 12 to the non-marring part 14, that only the use of a tool can thereafter separate them. For this reason the invention is well suited to the rigors of a contact sport like football, lacrosse or hockey, without being concerned that the non-marring part might become disconnected from the metal part of the buckle assembly.

The non-marring part 14 also includes one intermediate portion 14*n* that connected to and between the inside surfaces of the side walls. In the embodiments of FIGS. 1 and 5, this intermediate portion 14*n* acts like a bridge between the side walls 14*c* and 14*d*. In embodiments illustrated in FIGS. 4, 6 and 7, there are two intermediate portions 14*n*, each connected to one of the side walls.

In all embodiments of the invention, the metal plate 16 resting on the shelves 14*e* and 14*e*, and on each intermediate portion 14*n* and is locked in the tray by the plurality of locking tabs 14*g*, 14*h* and 14*i*. Also, the distance between each locking surface 14*m* on the one hand, and the upper surfaces of each intermediate portion 14*n* and the shelves 14*e* and 14*e*, is equal to the thickness of the metal plate 16 to insure a tight fit with no play between the metal part 12 and the non-marring part 14.

To help lock a plastic chin strap (not shown) to the buckle assembly of the invention, each slot 16*d* and 16*e* has one side with plural teeth 16*h* and 16*i*, each side with plural teeth being at the same end of the metal part. In addition, each end walls 14*a* and 14*b* is lower than each side walls 14*c* and 14*d* to the extend that the upper surface of each end wall as shown in FIG. 2, is coplanar with the upper surface of the metal plate 16 at each end of the buckle assembly. This allows the chin strap to be easily passed through the slots 16*d* and 16*e* until the strap is pulled taught and is engaged by the teeth 16*h* and 16*j* which thereafter prevents any further relative motion between the buckle assembly and the strap.

As mentioned, when one intermediate portion 14*n* is used, is forms a bridge connected between the side walls 14*c* and 14*d*. To fully expose the strap slots 16*d* and 16*e*, minimize interference between the non-marring part of the buckle assembly and the chin strap as well as fully mating of the metal part 12 to the non-marring part 12, the one intermediate portion 14*n* includes a recess 14*j* for receiving the enlarged end of the rivet 16*g* that projected above the surface of the plate 16. The bridge 14*n* has an end-to-end width that is about 12 to 45 percent of the total end-to-end width of the non-marring part 14. As shown FIG. 1, this range may be about 40 to 45 percent of the total end-to-end width of the non-marring part 14 if the rivet head is to be fully covered, or, as shown in FIG. 5, this range may be about 12 to 20 percent of the total end-to-end width of the non-marring part 14 if the rivet head is to be partly covered.

Figure 4:
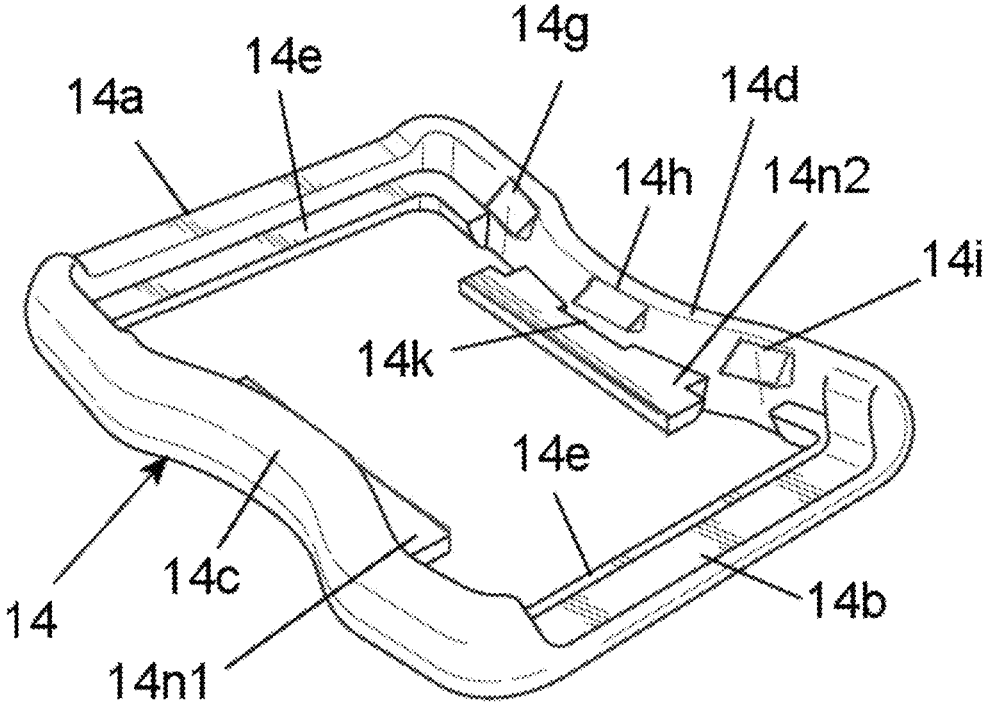
FIG. 4 is an inside perspective view of the non-marring part of an alternate embodiment of the buckle assembly of the invention.
Figure 5:
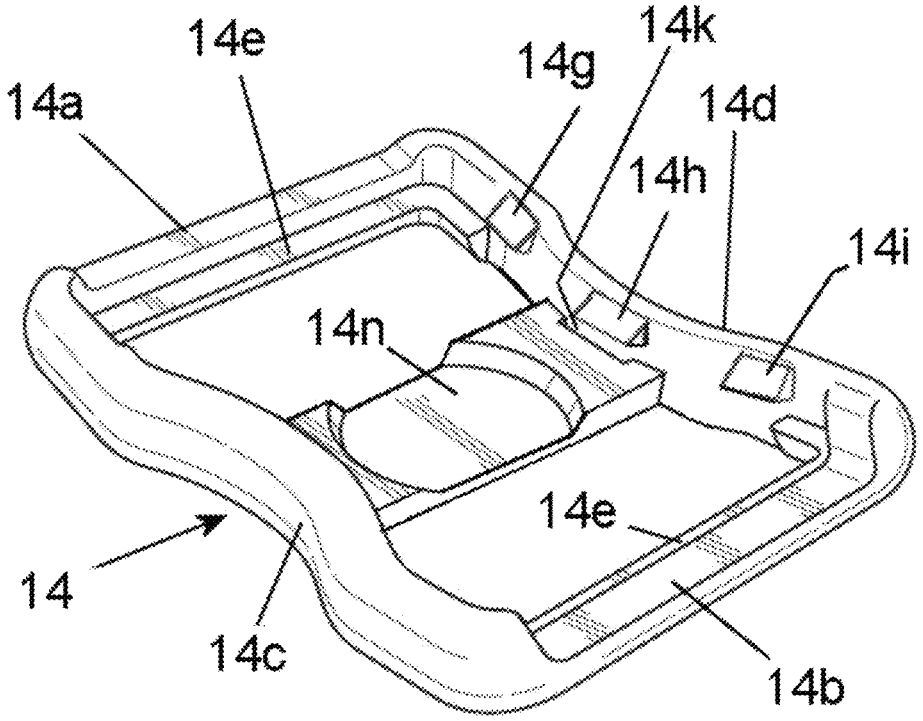
FIG. 5 is an inside perspective view of the non-marring part of a further embodiment of the buckle assembly of the invention.
Figure 7:
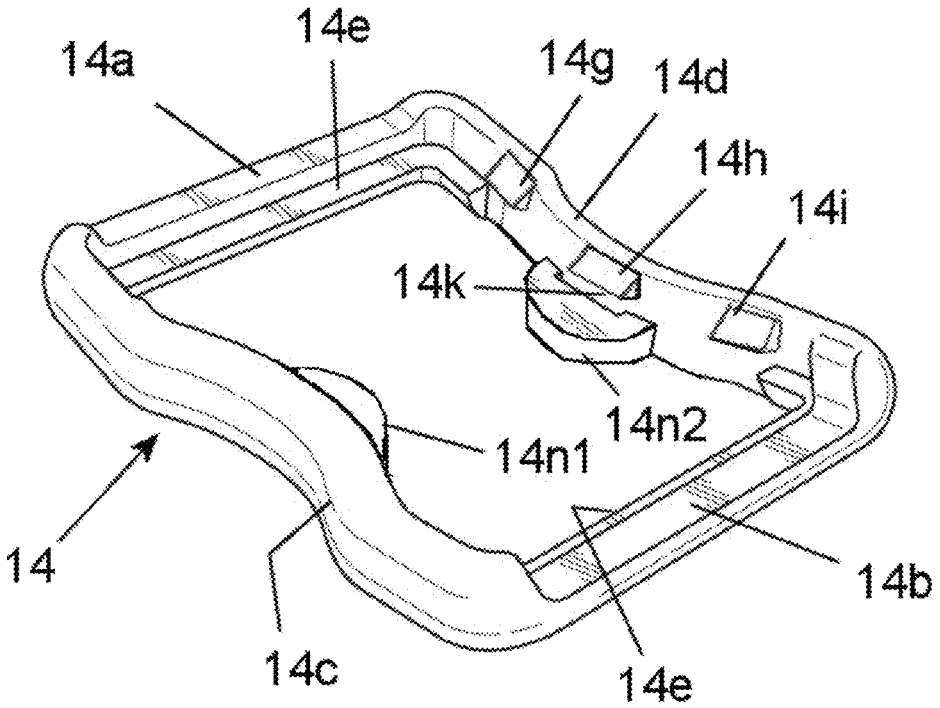
FIG. 7 is an inside perspective view of the non-marring part of another alternate embodiment of the buckle assembly of the invention.

With reference to FIGS. 4, 6 and 7, the intermediate portion 14*n* may comprise separate ledges 14*n*1 and 14*n*2 on the inner surfaces of the respective side walls 14*c* and 14*d*. In FIG. 4, the ledges 14*n*1 and 14*n*2 are rectangular. In FIG. 6, they are concave and shaped to receive respective parts of the rivet 16*g*. In FIG. 7 the intermediate portion ledges 14*n*1, 14*n*2 are convex.

The one intermediate portion 14*n* or two intermediate portion ledges 14*n*1 and 14*n*2 also include a slot or opening 14*k* adjacent each side wall 14*d* under the adjacent locking tab 14*h* with its locking surface 14*m* spaced over the opening. This opening is about the same width as the width of the locking surface 14*m* the was found to be necessary to properly mold the locking tab 14*h* accurately to shape and was only discovered as part of the invention development process. There is also a space left between the end of each shelf 14*e* and 14*e* and the nearest part of the intermediate portion 14*n* or portions 14*n*1 and 14*n*2, that is about but slightly longer than the length of a locking surface 14*m* over this space, again to facilitate the molding process.

Figure 9:
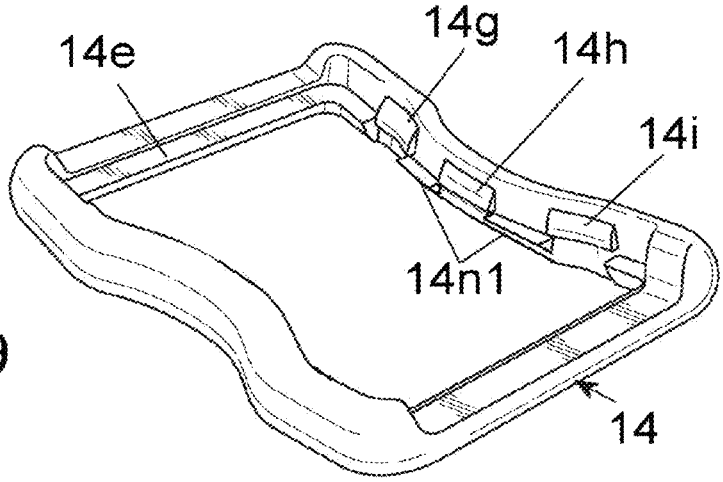
FIG. 9 is an inside perspective view of the non-marring part of another alternate embodiment of the buckle assembly of the invention.
Figure 10:
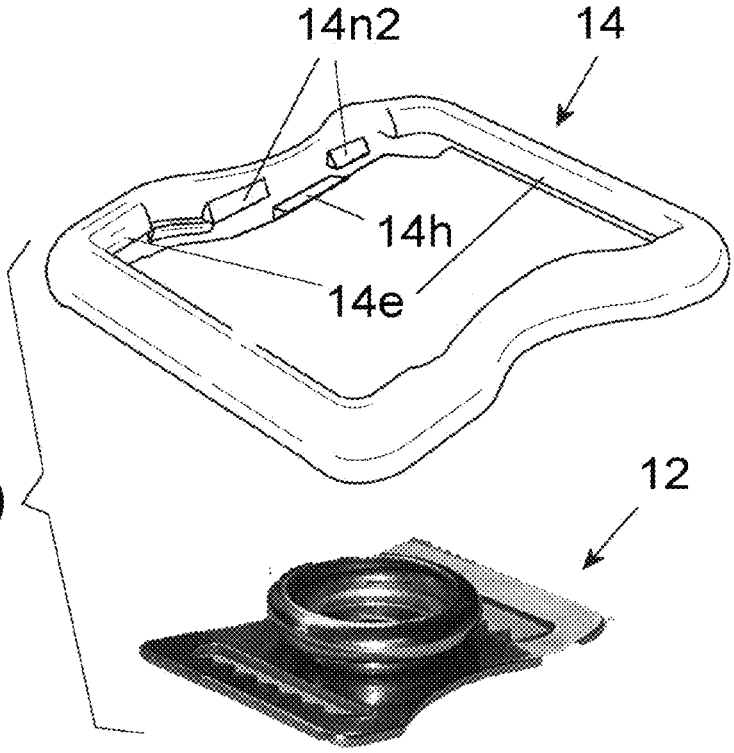
FIG. 10 is an outside exploded perspective view of a buckle assembly of the embodiment of FIG. 9, with its metal part also shown.

FIGS. 9 and 10 illustrate a still further embodiment of the buckle assembly of the invention with small two intermediate ledge portions 14*n*1 and 14*n*2 so that the non-marring part 14 is in the form of a buckle sleeve around the metal plate of the metal part 12.

Figure 11:
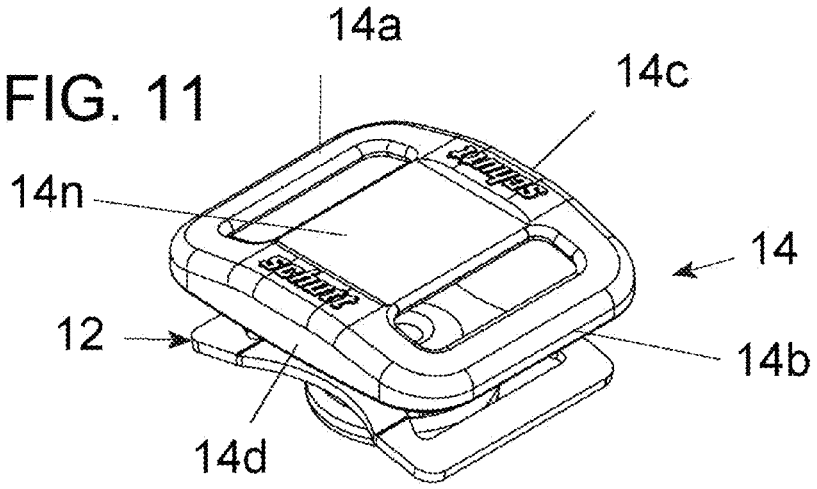
FIG. 11 is an exploded view of a further embodiment of the invention.
Figure 12:
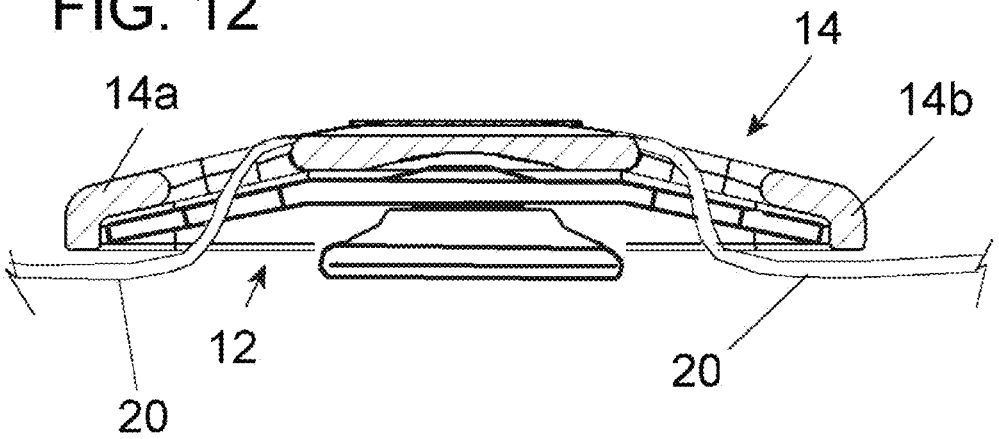
FIG. 12 is a sectional view of the embodiment of FIG. 11.

With reference to FIGS. 11 and 12, the non-marring part 14 comprises a tray made of polycarbonate or other strong plastics material. The tray has two end walls 14*a* and 14*b*, and two side walls 14*c* and 14*d* that are connected between the end walls and a bridge 14*n* connected between the side walls 14*c*, 14*d*. The end and side walls together defining an inner perimeter corresponding in shape and size to the outer perimeter of the metal plate of the metal part 12, and closely receives the metal plate within the tray. A single continuous rectangular shelf extends around the inside of the part 14 and a flexible strap 20, such as the chin strap of a football helmet, extends through the aligned slots of the parts 12 and 14 to keep the parts together with no other locking of the parts to each other, other than the plate of the metal part being nested in the perimeter and on the shelf of the non-marring part. To streamline the overall contour of the buckle, and further reduce the tendency for any part of the buckle to catch on clothing, equipment of other players, the strap 20 lies in a recess defined by the bridge 14*n* which is recessed lower than the outer surfaces of the side walls 14*c*, 14*d* by about the thickness of the strap.

While specific embodiments of the invention have been shown and described in detail to illustrate the application of the principles of the invention, it will be understood that the invention may be embodied otherwise without departing from such principles.

What is claimed is:

1. A buckle assembly (10) for holding a chin strap to a sports helmet, comprising:

a metal part (12) securely connected to a non-marring part (14);

the metal part (12) comprising a metal plate (16) having an outer perimeter with opposite end portions (16*a*, 16*b*) and a center portion (16*c*) between the end portions, a slot (16*d*, 16*e*) extending side-to-side in each end portion, and a snap member (16*f*) fixed to the center portion (16*c*) between the slots; and the non-marring part (14) comprising a tray having two end walls (14*a*, 14*b*) and two side walls (14*c*, 14*d*) connected between the end walls, the end and side walls together defining an inner perimeter corresponding in shape to, and receiving, the outer perimeter of the metal plate, a shelf (14*e*, 14*e*) extending side-to-side on an inner surface of each end wall, a plurality of locking tabs (14*g*, 14*h*, 14*i*) on an inner surface of each side wall, and at least one intermediate portion (14*n*) connected to the inside surface of each side wall, the metal plate resting on the shelves (14*e*, 14*e*) and on each intermediate portion (14*n*) and being locked in the tray by the locking tabs.

2. The buckle assembly of claim 1, wherein each slot (16*d*, 16*e*) has one side with plural teeth (16*h*, 16*i*).

3. The buckle assembly of claim 1, wherein each slot (16*d*, 16*e*) has one side with plural teeth (16*h*, 16*i*), each side with plural teeth being at the same end of the metal part.

4. The buckle assembly of claim 1, wherein each end walls (14*a*, 14*b*) is lower than each side walls (14*c*, 14*d*).

5. The buckle assembly of claim 1, wherein each end walls (14*a*, 14*b*) is lower than each side walls (14*c*, 14*d*), an upper surface of each end portion (16*a*, 16*b*) of the metal plate being substantially co-planar with an upper surface of each end wall (14*a*, 14*b*) of the tray.

6. The buckle assembly of claim 1, wherein each shelf (14*e*, 14*e*) extends partly onto the inner surface of each side wall (14*c*, 14*d*).

7. The buckle assembly of claim 1, wherein the at least one intermediate portion (14*n*) comprises a bridge connected between the side walls (14*c*, 14*d*).

8. The buckle assembly of claim 1, wherein the at least one intermediate portion (14*n*) comprises a bridge connected between the side walls (14*c*, 14*d*), the metal part including a rivet (16*g*) for fixing the snap member (16*f*) to the center portion (16*c*), the bridge including a recess (14*j*) for at least partly receiving a portion of the rivet (16*g*).

9. The buckle assembly of claim 1, wherein the at least one intermediate portion (14*n*) comprises a bridge connected between the side walls (14*c*, 14*d*), the bridge (14*n*), the metal part including a rivet (16*g*) for fixing the snap member (16*f*) to the center portion (16*c*), the bridge including a recess (14*j*) for at least partly receiving a portion of the rivet (16*g*), the bridge (14*n*) having an end-to-end width that is about 12 to 45 percent of the total end-to-end width of the non-marring part (14).

10. The buckle assembly of claim 1, wherein the at least one intermediate portion (14*n*) comprises a bridge connected between the side walls (14*c*, 14*d*), the bridge (14*n*), the metal part including a rivet (16*g*) for fixing the snap member (16*f*) to the center portion (16*c*), the bridge including a recess (14*j*) for at least partly receiving a portion of the rivet (16*g*), the bridge (14*n*) having an end-to-end width that is about 40 to 45 percent of the total end-to-end width of the non-marring part (14).

11. The buckle assembly of claim 1, wherein the at least one intermediate portion (14*n*) comprises a bridge connected between the side walls (14*c*, 14*d*), the bridge (14*n*), the metal part including a rivet (16*g*) for fixing the snap member (16*f*) to the center portion (16*c*), the bridge including a recess (14*j*) for at least partly receiving a portion of the rivet (16*g*), the bridge (14*n*) having an end-to-end width that is about 12 to 20 percent of the total end-to-end width of the non-marring part (14).

12. The buckle assembly of claim 1, wherein the at least one intermediate portion (14*n*) comprises a separate ledge (14*n*1, 14*n*2) on the inner surface of each side wall (14*c*, 14*d*).

13. The buckle assembly of claim 1, wherein the at least one intermediate portion (14*n*) comprises a separate ledge (14*n*1, 14*n*2) on the inner surface of each side wall (14*c*, 14*d*), each ledge being rectangular.

14. The buckle assembly of claim 1, wherein the at least one intermediate portion (14*n*) comprises a separate ledge (14*n*1, 14*n*2) on the inner surface of each side wall (14*c*, 14*d*), each ledge being concave.

15. The buckle assembly of claim 1, wherein the at least one intermediate portion (14*n*) comprises a separate ledge (14*n*1, 14*n*2) on the inner surface of each side wall (14*c*, 14*d*), each ledge being convex.

16. The buckle assembly of claim 1, wherein each locking tabs (14*g*, 14*h*, 14*i*) has an entry surface (141) that is inclined with respect to the inner surface of the side wall to which the locking tab is connected, and a locking surface (14*m*) that is substantially perpendicular to the inner surface of the side wall to which the locking tab is connected.

17. The buckle assembly of claim 1, wherein the at least one intermediate portion (14*n*) includes an opening (14*k*) adjacent each side wall (14*d*), one of the locking tabs (14*h*) having a locking surface (14*m*) spaced over the opening.

18. The buckle assembly of claim 1, wherein each locking tabs (14*g*, 14*h*, 14*i*) has an entry surface (141) that is inclined with respect to the inner surface of the side wall to which the locking tab is connected, and a locking surface (14*m*) that is substantially perpendicular to the inner surface of the side wall to which the locking tab is connected, the at least one intermediate portion (14*n*) including an opening (14*k*) adjacent each side wall (14*d*), one of the locking tabs (14*h*) having its locking surface (14*m*) spaced over the opening.

19. The buckle assembly of claim 1, wherein each locking tabs (14*g*, 14*h*, 14*i*) has an entry surface (141) that is inclined with respect to the inner surface of the side wall to which the locking tab is connected, and a locking surface (14*m*) that is substantially perpendicular to the inner surface of the side wall to which the locking tab is connected, the at least one intermediate portion (14*n*) including an opening (14*k*) adjacent each side wall (14*d*), one of the locking tabs (14*h*) having its locking surface (14*m*) spaced over the opening, each shelf (14*e*, 14*e*) extending partly onto the inner surface of each side wall (14*c*, 14*d*), a spacing between each intermediate portion (14*n*, 14*n*1, 14*n*2) and a nearest shelf (14*e*, 14*e*) being at least equal to a length of a locking surface (14*m*) positioned over the spacing.

20. The buckle assembly of claim 1, wherein the center portion (16*c*) is narrower than the opposite end portions (16*a*, 16*b*).

21. A buckle and strap assembly (10, 20) for holding the strap to a sports helmet, comprising:

a metal part (12) engaged to a non-marring part (14);

the metal part (12) comprising a metal plate having an outer perimeter with opposite end portions and a center portion between the end portions, a slot extending side-to-side in each end portion, and a snap member fixed to the center portion (16*c*) between the slots;

the non-marring part (14) comprising a tray having two end walls (14*a*, 14*b*) and two side walls (14*c*, 14*d*) connected between the end walls, the end and side walls together defining an inner perimeter corresponding in shape to, and receiving, the outer perimeter of the metal plate, a shelf extending on an inner surface of each end wall and each side wall, the metal part being nested in the end and side walls and on the shelf, with a bridge (14*n*) extending between the side walls and over the plate; and a flexible strap (20) extending through the slots of the plate and over the bridge (14*n*), for holding the metal and non-marring parts together.

22. The buckle and strap assembly of claim 21, wherein the bridge defines a recess that is lower than outer surfaces of the side walls for receiving the strap.

23. The buckle and strap assembly of claim 21, wherein the bridge defines a recess that is lower than outer surfaces of the side walls for receiving the strap, the recess being lower than the outer surfaces of the side walls by about the thickness of the strap.

* * * * *